US005287143A

United States Patent [19]

Hirota et al.

[11] Patent Number: 5,287,143

[45] Date of Patent: Feb. 15, 1994

[54] IMAGE FORMING APPARATUS WITH MOVEABLE COVER

[75] Inventors: Shoji Hirota; Hiromitsu Koizumi, both of Saitama, Japan

[73] Assignee: Fuji Xerox Co., Ltd., Tokyo, Japan

[21] Appl. No.: 875,055

[22] Filed: Apr. 28, 1992

[30] Foreign Application Priority Data

Apr. 30, 1991 [JP] Japan ..... 3-126810

[51] Int. Cl.[5] ..... G03G 15/00

[52] U.S. Cl. ..... 355/200; 355/210

[58] Field of Search ..... 355/210, 200, 211, 260

[56] References Cited

U.S. PATENT DOCUMENTS

| | | | |
|---|---|---|---|
| 4,641,947 | 2/1987 | Ishida et al. | 355/200 |
| 4,754,293 | 6/1988 | Aizawa et al. . | |
| 5,047,803 | 9/1991 | Kanoto | 355/211 |
| 5,115,272 | 5/1992 | Ohmori et al. | 355/200 |

FOREIGN PATENT DOCUMENTS

| | | |
|---|---|---|
| 0285139A2 | 10/1988 | European Pat. Off. . |
| 62-105857 | 5/1987 | Japan . |
| 63-244064 | 10/1988 | Japan . |
| 1-314256 | 12/1989 | Japan . |

*Primary Examiner*—A. T. Grimley
*Assistant Examiner*—Shuk Y. Lee
*Attorney, Agent, or Firm*—Finnegan, Henderson, Farabow, Garrett & Dunner

[57] ABSTRACT

An image forming apparatus using an electrophotographic system. The image forming apparatus includes a body frame; an image forming unit having at least a photoreceptor and being detachably contained in the body frame; a forward unit for forwarding a sheet to the image forming unit, the forward unit having at least two forward members, one of the forward members being disposed at a disturbing position when the image forming unit is detached from the body frame; a moving frame being disposed so as to be opened and closed relative to the body frame and having a first opening position and a second opening position, the second opening position having an opening distance greater than the first opening position; and a coupling unit for coupling the moving frame with the forward unit so that when the moving frame is opened to the first opening position, the other of the forward members is distanced from the one of the forward members with the one of the forward members being at a position closing the moving frame, while when the moving frame is opened to the second opening position, the one of the forward members is moved to an undisturbing position when the image forming unit is detached from the body frame.

10 Claims, 8 Drawing Sheets

IMAGE FORMING APPARATUS WITH MOVEABLE COVER

BACKGROUND OF THE INVENTION

1. Field of the Invention

The invention relates to an image forming apparatus using an electrophotographic system, and more particularly to the apparatus in which a cover member that can be separated from its main body having an image forming means with a sheet forward path as a demarcation is implemented by a rocking frame or a moving frame.

2. Description of the Related Art

An image forming apparatus such as an electronic copying machine or a printer employs a system in which a copy is made by forming a toner image on a photoreceptor drum, transferring the toner image onto a sheet, and fusing the transferred toner image afterwards through a fuser. This image forming apparatus is also designed so that sheets are fed from a unit such as a sheet feed cassette disposed on a sheet feed section of the apparatus one by one using a sheet feeder and forwarded toward an image transfer section of the photoreceptor drum. Among such image forming apparatuses is a comparatively small image forming apparatus that is designed so that its frames can be opened and closed with a sheet forward path as a border, and, e.g., when a sheet is stopped inside the sheet forward path, one of the frames is opened to free the sheet feed path so that the jam can be taken care of with ease. Further, as described above, the image forming apparatus in which one of the frames can be opened and closed facilitates the operation of inspecting the image forming means or replacing various units, etc., by opening the frame.

In addition to the above-mentioned ordinary image forming apparatuses, some small printers are designed in such a manner that an image forming means is arranged so as to confront the printer body and that a frame is separable from the printer body with a sheet forward path as a border, so that the operation of handling jams or maintenance of the printer can be performed conveniently. In an example proposed, e.g., in Japanese Patent Unexamined Publication No. Sho. 63-244064 and the like, a printer includes: a unitized image forming member on the printer body; an opening/closing frame that can be opened and closed with respect to the printer body; and such components as a sheet forward means, a fuser, and the like so as to confront the opening/closing frame, so that the opening/closing frame can be opened to perform maintenance or jamming processing inside the sheet forward path.

However, in the above-mentioned conventional printer, a forward roller unit of the sheet forward path is provided integrally with the opening/closing frame. As a result, jammed sheets are left nipped between the forward rollers under strong nip pressure, thus making the operation of removing the jammed sheets cumbersome. Further, if a means for supporting only one of the forward rollers with respect to the opening/closing frame is provided, the jamming can be handled easily, but the roller becomes an obstacle, e.g., to taking the image forming member out.

To overcome the above problems, a printer is proposed, e.g., in Japanese Patent Unexamined Publication No. Hei. 1-314256. In this printer, when opening the opening/closing frame with the sheet forward path as a demarcation, its fuser is left on the printer body side and only a part of the sheet forward path is opened. However, the thus constructed opening/closing frame is to be opened with the forward roller unit of the sheet forward path nipping a sheet therebetween, thus leaving the jam handling problem unsolved.

SUMMARY OF THE INVENTION

The invention has been made to overcome the above-mentioned problems associated with the conventional apparatuses. Accordingly, an object of the invention is to provide an apparatus in which the opening/closing frame can be opened with the sheet forward path as a border by two different degrees of opening angle or moving condition. When the frame is opened by a small degree, the nip applied to the forward roller unit is released, while when the frame is opened by a large degree, the forward roller unit is distanced away from the apparatus body, so that maintenance or the like can be performed easily.

In order to accomplish the above object, the invention provides an image forming apparatus comprising a body frame; an image forming unit having at least a photoreceptor and being detachably contained in the body frame; a forward unit for forwarding a sheet to the image forming unit, the forward unit having at least two forward members, one of the forward members being disposed at a disturbing position when the image forming unit is detached from the body frame; a moving frame being disposed so as to be opened and closed relative to the body frame and having a first opening position and a second opening position, the second opening position having an opening distance greater than the first opening position; and coupling means for coupling the moving frame with the forward unit so that when the moving frame is opened to the first opening position, the other of the forward members is distanced from the one of the forward members with the one of the forward members being at a position closing the moving frame, while when the moving frame is opened to the second opening position, the one of the forward members is moved to an undisturbing position when the image forming unit is detached from the body frame.

DETAILED DESCRIPTION OF THE PREFERRED EMBODIMENTS

Figure 1:
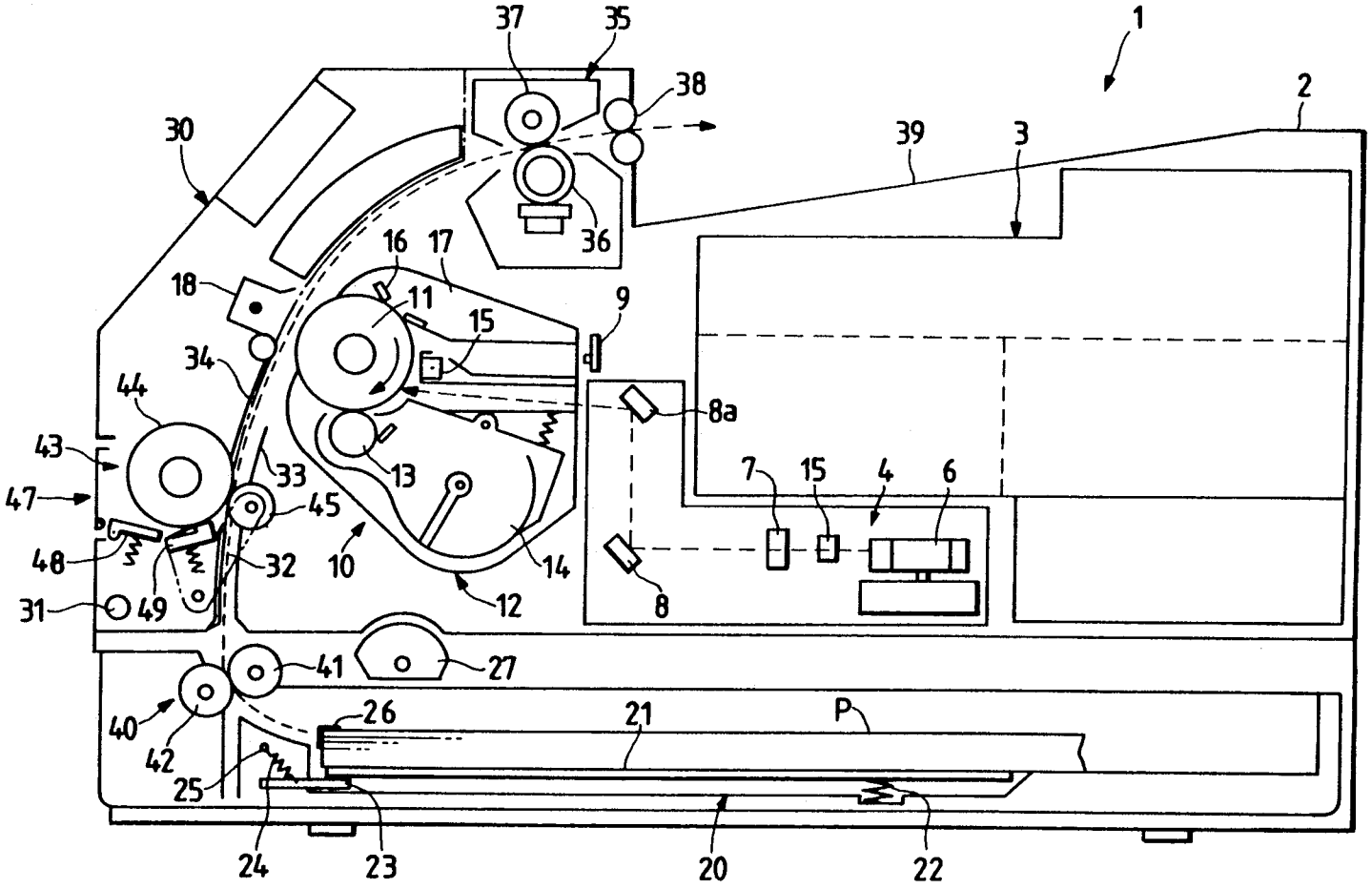
FIG. 1 is a diagram illustrative of a construction of a printer which is an embodiment of the invention.

An image forming apparatus according to an embodiment of the invention will be described with reference to the accompanying drawings. In FIG. 1, a laser printer 1 as the image forming apparatus has a rocking frame 30 arranged so as to be opened and closed relative to a body frame 2 with a sheet forward path 32 as a border. The body frame 2 of the printer 1 includes, like other ordinary laser printers, a writing unit 4 and a unitized image forming member 10. Using a laser beam outputted from the writing unit 4, image data is written onto a photoreceptor drum 11, a toner image formed on the photoreceptor drum 11 is then transferred onto a sheet, and the transferred image is fused by a fuser 35 to produce a copy. The writing unit 4 arranged on the body frame 2 of the laser printer 1 is operated in such a manner that a control section 3 applies image information to the writing unit 4 in response to an image signal from an image information output unit such as a microcomputer or a word processor and that the image information is written by a laser beam outputted from the writing unit 4. The control section 3 includes not only a power supply unit required for driving the printer or for a charger, such as a high-voltage power supply and a low-voltage power supply, but also a control unit for operating the various units of the printer, and an image information processor for an image forming mechanism of the writing unit. Like ordinary writing units, the writing unit 4 reflects a laser beam applied from a laser oscillator 5 by a polygon mirror 6, forms an image through an $f\theta$ lens 7, and irradiates the reflected laser beam onto the photoreceptor drum 11 through a plurality of mirrors 8 and 8*a*. Also., the photoreceptor drum 11 for forming a toner image is included in the image forming member 10 in which electrophotographic systems are unitized. This unit 10 consists of the photoreceptor drum 11, a developing unit 12, a cleaning unit, and a charge corotron 15, and the like.

The developing unit 12 constituting the image forming member unit has a developing roller 13 and a toner container 14 that delivers toner contained therein toward the developing roller 13 using a stirring/forwarding means. Further, by forming a thin layer of toner on the surface of the developing roller 13 to expose the formed layer to the photoreceptor drum 11, the developing unit 12 causes the toner to adhere to a latent electrostatic image formed on the photoreceptor drum 11. The cleaning unit employs a cleaning blade 16 in this embodiment, and the toner, sheet dust, and the like scraped from the surface of the photoreceptor drum by the blade 16 are accommodated into a recovered toner hopper 17. Further, the image forming member unit 10 has the charge corotron 15 that is formed into a very small unit between the cleaning unit and the developing unit 12. The charge corotron 15 uses its unit frame as its wire supporting frame, thereby employing no shield such as used in ordinary chargers.

With respect to the writing unit and the toner image forming means having the image forming member such as described above, the printer 1 arranges a sheet feeder at a lower portion of the apparatus body. A sheet feed cassette 20 used in the printer is of such a type that a bottom plate 21 is supported by a spring 22 and pushing-up arms 23 and involves a means for feeding sheets while holding the sheets supported by the bottom plate 21 substantially horizontally. The pushing-up arms 23 for pushing the front end of the bottom plate 21 which is the sheet feed side are connected to a support bar 25 through springs 24, respectively, and when the sheet feed cassette 20 is installed to the sheet feed unit, the support bar 25 becomes elevated to cause the arms 23 to be rocked by springs 24 and thereby bias the bottom plate 21 upward. The sheets supported by the bottom plate 21 are biased or urged against a sheet feed roller 27, and when the sheet feed roller 27 begins rotating, a sheet that has been regulated by a snubber 26 is fed into the sheet feed path 32.

The sheet forward path 32 consists of an inner guide plate 33 disposed on the body frame 2 and an outer guide plate 34 disposed on the rocking frame 30, and has two sets of forward roller units 40 and 43. The lower forward roller unit 40 arranges a pinch roller 42 disposed on the sheet feed cassette and a drive roller 41 disposed on the apparatus body so as to confront each other, allowing a sheet fed from the sheet feed cassette by the sheet feed roller 27 to be forwarded along the sheet forward path 32. Also, the upper forward roller unit 43 arranges a large-diameter drive roller 44 and a pinch roller 45 so as to confront each other, allowing the sheet to be forwarded at a predetermined speed by the forward roller unit 43 and transfer a toner image formed on the photoreceptor drum 11 onto the sheet by discharge of a transfer corotron 18 provided on the image transfer section.

The drive roller 44 constituting the upper forward roller unit 43 is used also as a sheet feed roller for a manual sheet feed unit 47. The manual sheet feed unit 47 allows a sheet to be inserted by taking away a cover member of the rocking frame 30. The unit 47 consists of an insertion guide 48 and an regulating pad 49 that confronts the drive roller 44. The sheet inserted through the manual sheet feed unit 47 is fed into the sheet feed path 32 by the sheet feed roller 43 and is subjected to an image transfer process. On the uppermost end portion of the sheet forward path 32 is the fuser 35. The fuser 35 is implemented by a heat roller unit in which a heat roller 36 and a pressure roller 37 are arranged so as to confront each other and a predetermined nip pressure is set between both rollers. Also, in the downstream side of the fuser are discharge rollers 38, which discharge a copy into a discharge tray 39.

Figure 2:
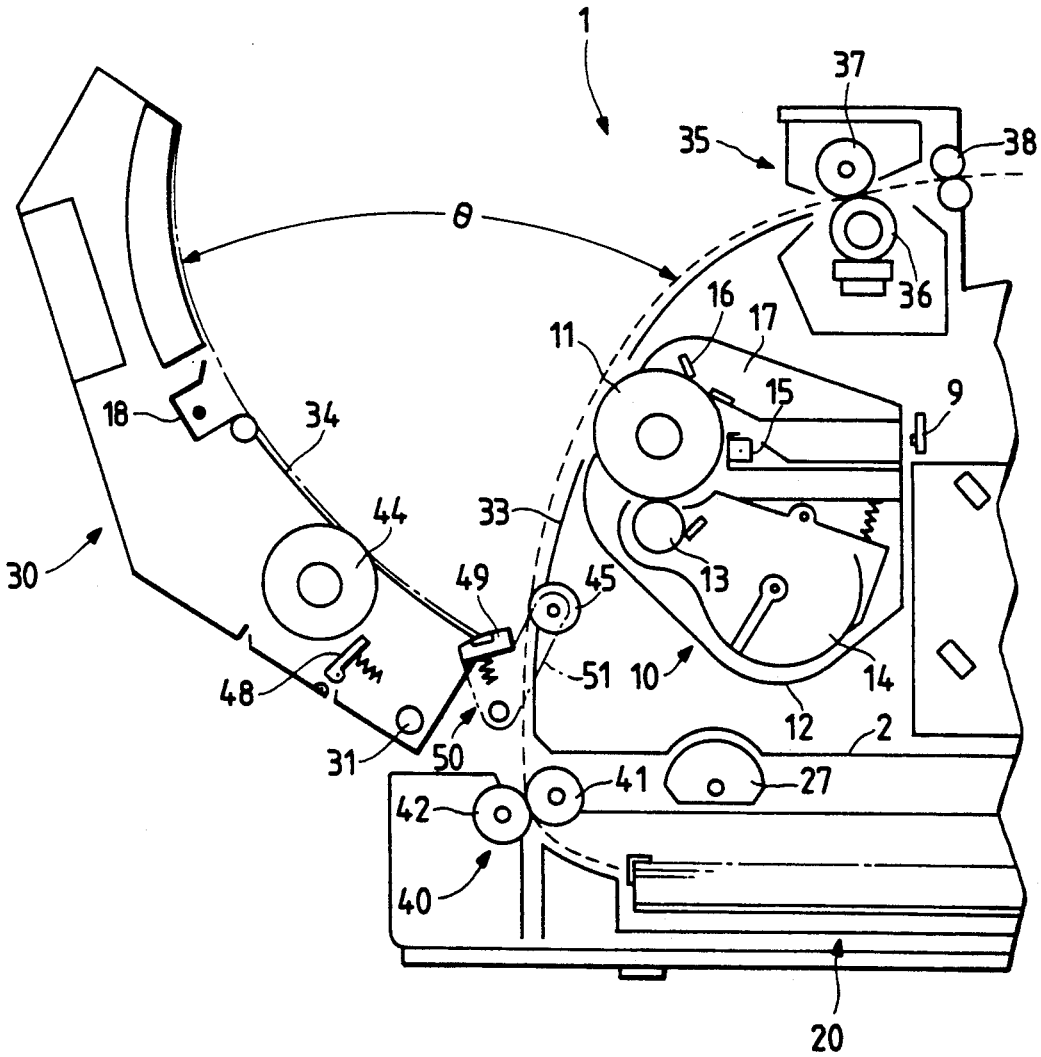
FIG. 2 is a diagram illustrative of a condition in which a rocking frame is opened to release a sheet forward path.

In the printer 1 constructed as shown in FIG. 1, when a sheet is suspended at a portion on the sheet forward path 32, the rocking frame 30 is opened through a support shaft 31, thereby removing the jammed sheet from the sheet forward path 32. As described above, to open the sheet forward path 32 to remove the jammed sheet, the rocking frame 30 is opened at an opening angle $\theta$ of 45° to 60° to free the sheet forward path 32 lo as shown in FIG. 2, so that the sheet suspended on the sheet forward path 32 can be taken out with ease. As shown in FIG. 2, when the rocking frame 30 is opened, the drive roller 44 constituting the upper forward roller unit 43 is distanced away from the pinch roller 45 together with the rocking frame 30, thus releasing the nip applied to the sheet.

Figure 3:
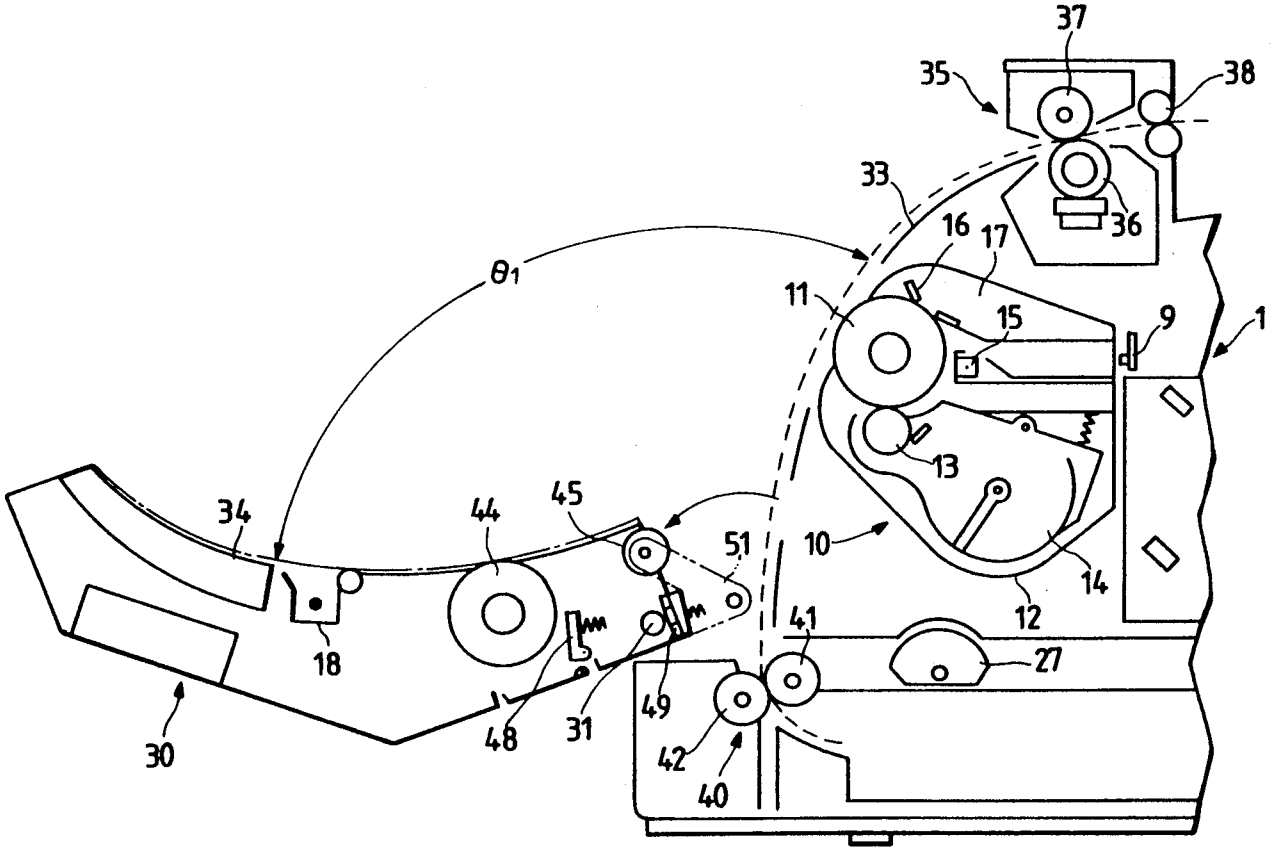
FIG. 3 is a diagram illustrative of a condition in which the rocking frame is opened by a large degree.

When the rocking frame 30 is further opened up to an angle θ1 from the above condition, as shown in FIG. 3, a member 50 supporting the pinch roller 45 follows the moving of the rocking frame 30 to be rocked counterclockwise as viewed from FIG. 3 Further, the pinch roller 45 supported by a roller holding member 51 becomes separated from the body frame 2 to thereby open the sheet forward path side of the frame 2. Therefore, when the rocking frame 30 is opened to the angle θ1 in the manner described above, an ample opening can be provided on the sheet forward path side of the body frame, which, accordingly, facilitates the operation of replacing the image forming member 10 or the like. When the rocking frame 30 is closed from the condition shown in FIG. 3, all the rocked members are reset to the condition shown in FIG. 1.

Figure 4:
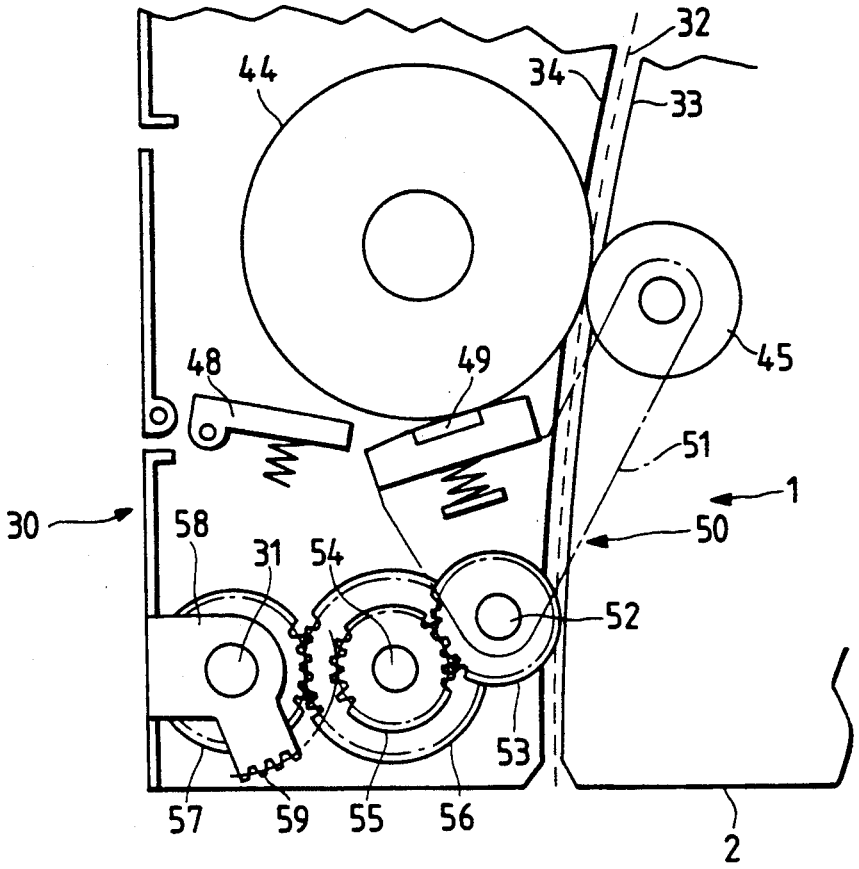
FIG. 4 is a diagram illustrative of a pinch roller supporting member and a rocking mechanism thereof.

In the mechanism of rocking the thus constructed rocking frame 30, the pinch roller rocking unit 50 supporting the pinch roller 45 of the forward roller unit 43 is constructed as shown in FIG. 4. In the pinch roller rocking unit 50, the pinch roller 45 and the pad 49 are supported by the roller holding member 51 that is arranged so as to be rockable around a support shaft 52. Further, a gear member 53 is provided integrally with the roller holding member 51 so that the gear member 53 is meshed with an intermediate gear 55 supported by an intermediate shaft 54. In addition to the intermediate gear 55, a transmission gear 56 is provided on the intermediate shaft 54. The transmission gear 56 is used as a gear transmitting force from a drive system of the body. The gear 56 is also used to drive the sheet feed roller (drive roller) 44 through a gear 57 disposed on the support shaft 31. A tooth member 59 supported by the support shaft 31 is also provided. The member 59 includes teeth only on a part of a support bracket 58 of the rocking frame 30, so that the tooth member 59 is engaged with the gear 55 only when the rocking frame 30 is rocked by a large degree to thereby rotate the roller holding member 51 through the gear 53 and rock the pinch roller 45 so as to be distanced away from the body as shown in FIG. 3.

Figure 5:
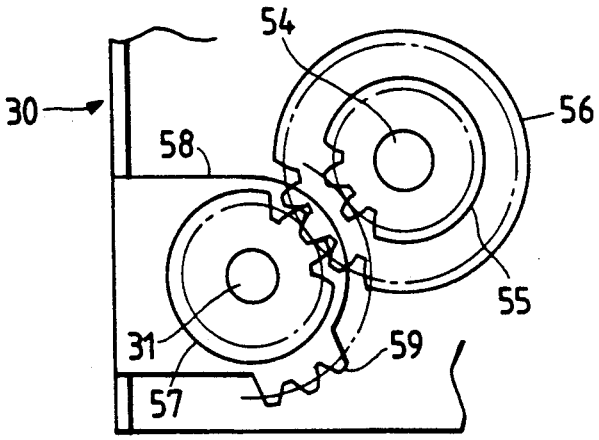
FIG. 5 is a diagram illustrative of a relationship between gears of a pinch roller rocking unit with the rocking frame closed.

In the thus constructed transmission gear unit, a relationship between the gear unit on the side of the rocking frame and the gear unit on the intermediate side is as shown in FIG. 5. FIG. 5 highlights a condition in which the gear for rocking the roller holding member is about to be meshed with the small gear 55 in the intermediate gear unit. As shown in FIG. 5, the condition in which the gear 56 is engaged with the gear 57 indicates that the rocking frame 30 is installed to the body frame normally and that a sheet is being forwarded within the sheet forward path formed between both frames. Under this condition, the roller holding member supporting the pinch roller is securely held to a position shown in FIG. 4.

Figure 6:
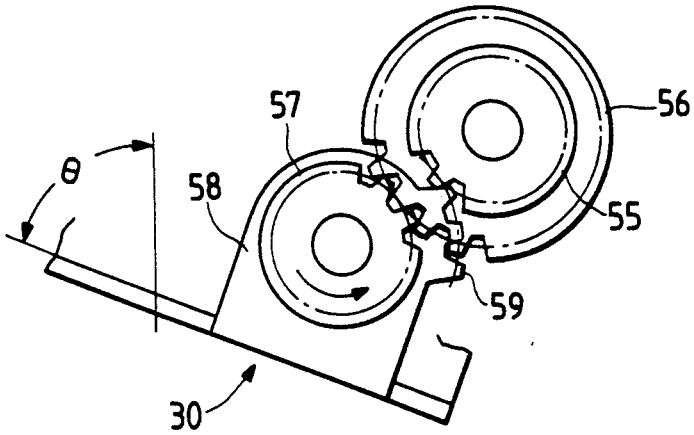
FIG. 6 is a diagram illustrative of a relationship between the gears under the condition corresponding to that shown in FIG. 2.
Figure 7:
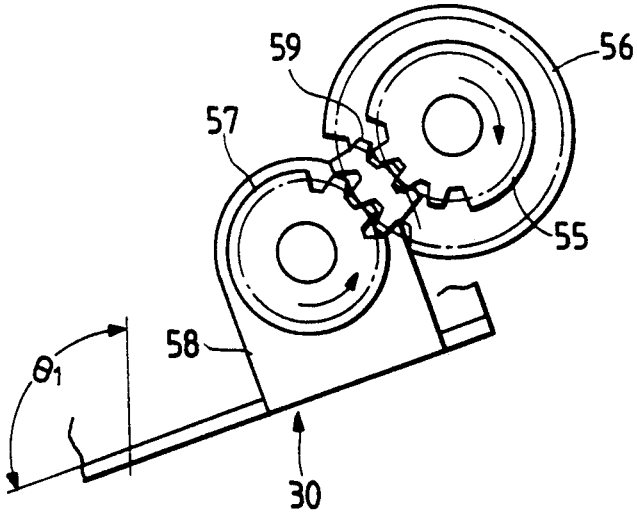
FIG. 7 is a diagram illustrative of a relationship between the gears under the condition corresponding to that shown in FIG. 3.

When the rocking frame 30 is rocked by the angle θ counterclockwise around the support shaft 31 from the condition shown in FIG. 5 to put the apparatus in the condition shown in FIG. 2, a relationship among the respective gears is as shown in FIG. 6. That is, the tooth member 59 provided on the bracket 58 supported by the rocking frame abuts against the small gear 55 and thereby only holds the gear while keeping it from rotating. Therefore, under the condition shown in FIG. 6, the pinch roller is left on the body frame side as shown in FIG. 2. In contrast thereto, if the rocking frame 30 is rocked by a larger degree, the tooth member 59 provided on the bracket 58 is meshed with the small gear 55 to rotate the gear 55 as shown in FIG. 7. Therefore, the roller holding member 51 supporting the pinch roller is rocked by a large degree both through the gear 53 meshed with the gear 55 and through the support shaft 52, and the pinch roller is thereby rocked in the direction of the rocking frame as shown in FIG. 3. In the pinch roller rocking unit shown in FIGS. 4 through 7, the support shaft 31 supports the rocking frame 30 to rotatably support the gear 57 freely, while the bracket 58 rocks together with the rocking frame. Further, the intermediate shaft 54 is supported by the body frame and the gear 55 is supported so as to be rotatable around the shaft 54. Further, the pinch roller rocking unit may include, other than the interlocking means shown in FIGS. 4 through 7, an arbitrary interlocking mechanism and a pinch roller supporting means.

Figure 8:
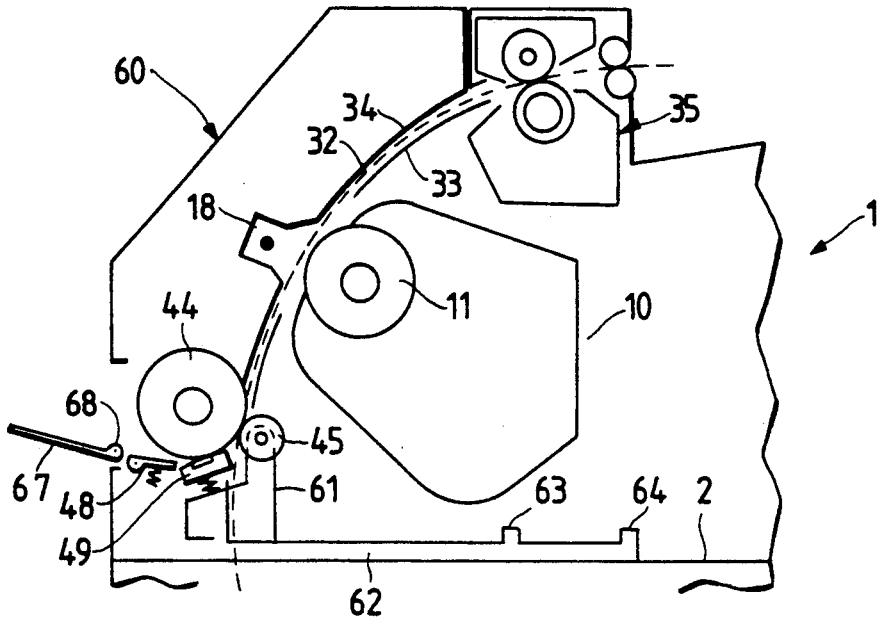
FIG. 8 is a diagram illustrative of an apparatus in which a movable frame is moved from a body frame.
Figure 9:
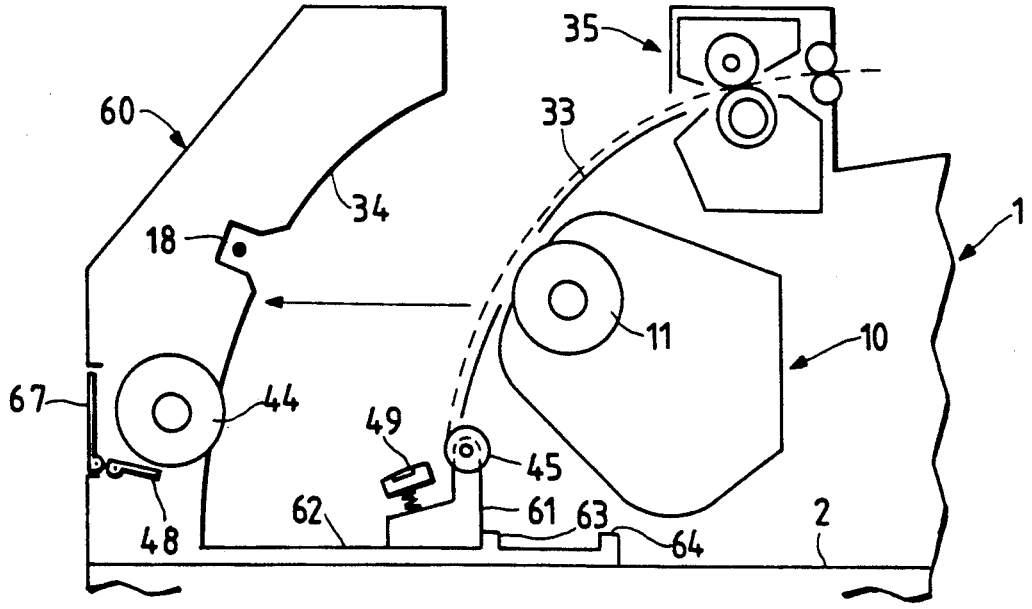
FIG. 9 is a diagram illustrative of a condition at the time of taking care of a jam in the printer shown in FIG. 8.
Figure 10:
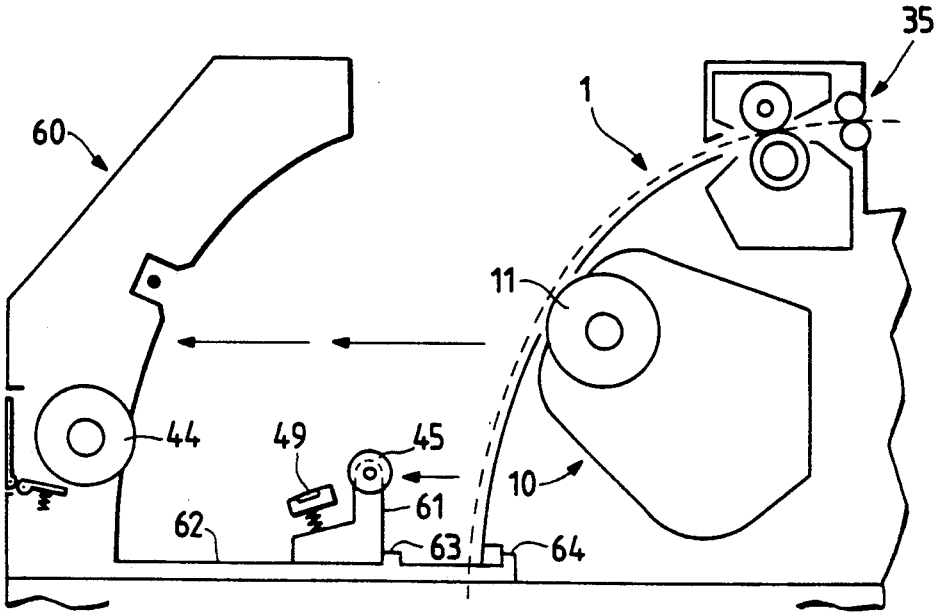
FIG. 10 is a diagram illustrative of a condition in which the movable frame is further moved.

In the image forming apparatus of the invention, in addition to the rocking frame 30 being arranged so as to be rockable relative to the body frame 2 through the support shaft as shown in FIG. 1, a moving frame may be used in place of the rocking frame and it may be arranged so that the moving frame is distanced away from the body frame 2 in the horizontal direction as shown in FIGS. 8 through 10. While a moving frame 60 is provided facing the body frame 2 in the printer 1 shown in FIG. 8, the moving frame 60 is designed so that it can be movable horizontally from the body frame. The embodiment shown in FIG. 8 is a case in which a manual sheet feed tray 67 is arranged so as to be opened and closed around a support shaft 68 relative to the moving frame 60. A sheet inserted from the manual tray is regulated by a sheet feed roller (drive roller) 44 and a pad 49 and fed into the sheet forward path. The use of the manual tray is applicable to the apparatus shown in FIG. 1.

In the printer shown in FIG. 8, the drive roller 44 constituting the forward roller unit is supported by the moving frame 60 as described above, while a pinch roller 45 is supported by a roller holding member 61 so that the pinch roller can be positioned. In this embodiment, slide rails 62 whose end portion is secured to the moving frame 60 and which go into and out from the lower portion of the body frame 2 is provided so that the moving frame 60 is movable relative to the body frame 2 therethrough. Also, stepped portions 63 and 64 that are projecting upward are provided on each slide rail 62, the intermediate stepped portion 63 being arranged so as to be engaged with the roller holding member 61.

In the above-mentioned printer, a sheet jammed in the sheet forward path can be removed by moving the moving frame 60 from the body frame by a predetermined distance in the direction of separating it from the body frame as shown in FIG. 9. Then, as the stepped portion 63 provided on each slide rail 62 has reached a position at which it is engaged with a holding member (not shown) of the roller holding member 61, only the drive roller 44 moves together with the moving frame, leaving the pinch roller 45 on the body frame side. Therefore, a large space is formed between both frames, leaving the sheet no longer nipped by the roller unit in the sheet forward path and thereby facilitating the removal of the sheet.

The moving frame 60 is further moved greatly from the condition shown in FIG. 9 toward the left, the roller holding member 61 held by the stepped portion 63 of each slide rail 62 moves together with the slide rail 62, causing the stepped portion 64 provided at an end portion of each slide rail 62 to brought into engagement with a holding member of the body frame 2 and thereby locking the slide rail 62 in position. Since the distance between both frames 2 and 60 is long under the condition shown in FIG. 10, the image forming member 10 can be attached and detached through such distance. Also, the mechanism for moving the moving frame 60 relative to the body frame 2 horizontally may be implemented not only by the slide rails as shown in the above embodiment, but may also be achieved by other interlocking means.

Figure 11:
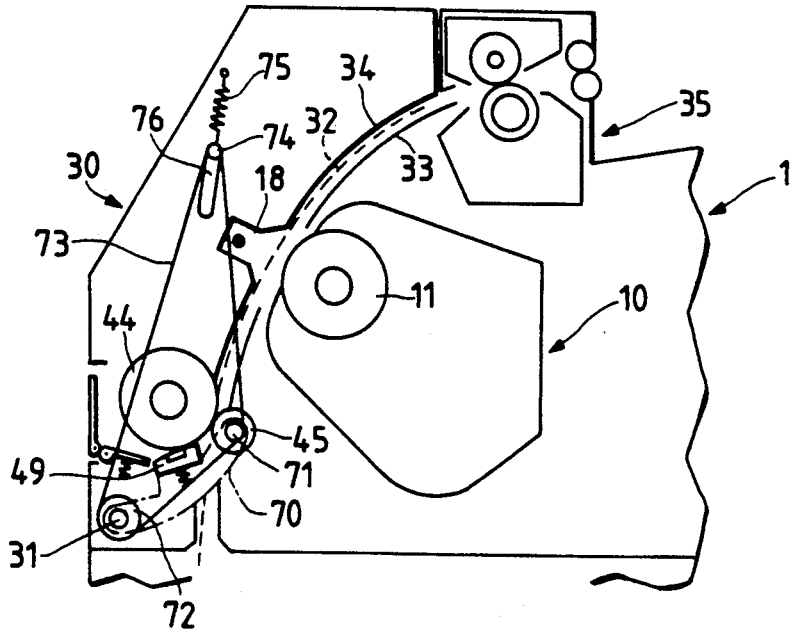
FIG. 11 is a diagram illustrative of an apparatus of such system that the operation of opening a rocking frame is transmitted to a roller holding member by wires.

To open the sheet forward path by rocking the rocking frame, a means for rocking the pinch roller using wires 73 as shown in FIG. 11 may be employed other than the means for rocking the pinch roller through the gear unit as shown in FIG. 1. In a printer shown in FIG. 11, a manual sheet feeder and a transfer corotron 18 are provided on a rocking frame 30, and the rocking frame 30 can be rocked through a support shaft 31. A roller holding member 70 supporting a pinch roller 45 is arranged so as to be rockable through the support shaft 31, and a rocking mechanism employing the wires 73 is provided for the roller holding member 70. Each wire 73 is installed on a roller shaft 71, a pulley 72 provided on the support shaft 31, and a pin 74 guided by a slot 76 provided on the frame 30.

Figure 12:
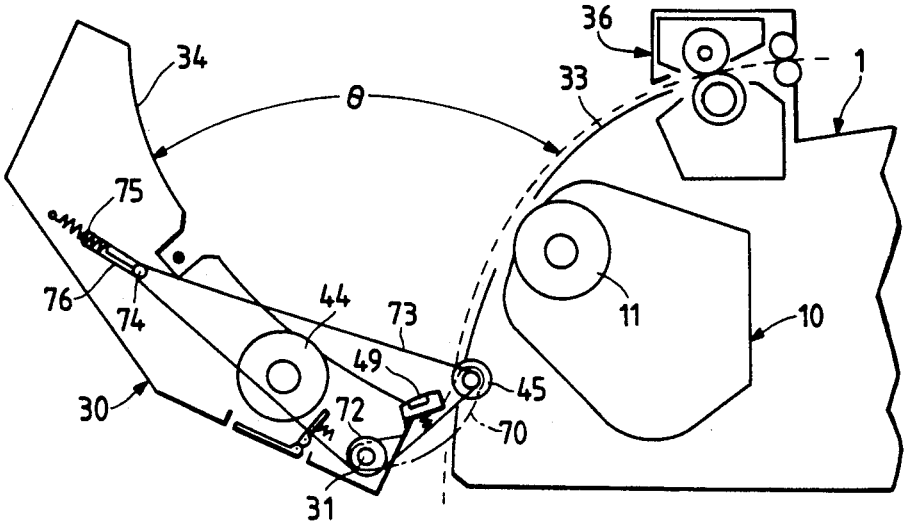
FIG. 12 is a diagram illustrative of the operation of opening the rocking frame at the time of jamming.

In the thus constructed printer a jammed sheet is removed by rocking the rocking frame 30 only by an angle $\theta$ as shown in FIG. 12. In this case, the pin 74 supporting the wire 73 slides downward along the slot 76 against the force of a spring 75 as the wire installation path changes, and the spring allows a predetermined tension to be given to the wire. Under the condition shown in FIG. 12, a drive roller 44 is moved together with the rocking frame 30, leaving the pinch roller 45 on the body frame 2 side and thereby allowing the operation of removing the jammed sheet in the sheet forward path to be performed.

Figure 13:
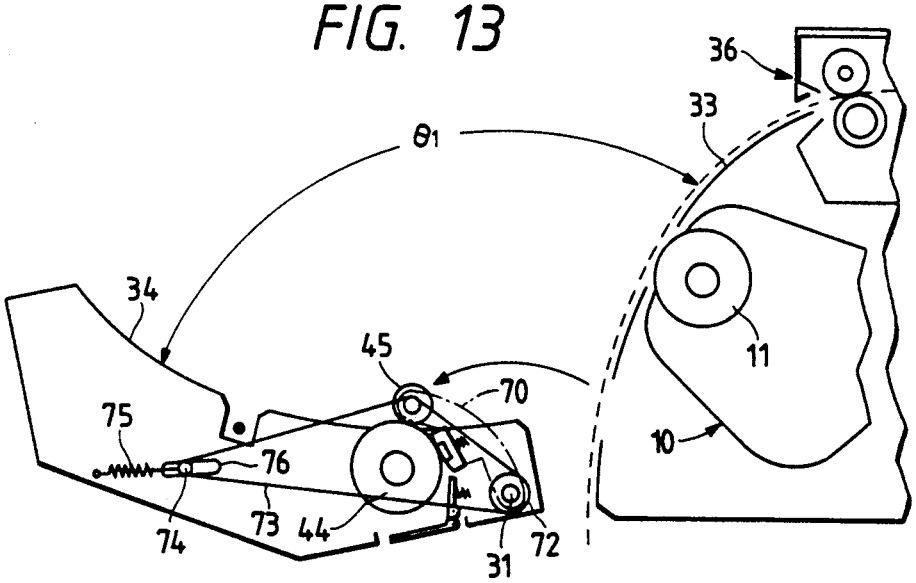
FIG. 13 is a diagram illustrative of a condition in which the rocking frame is opened by a large degree.

When the rocking frame 30 is further rocked greatly from the condition shown in FIG. 12, the roller holding member 70 is rocked through each wire 73, causing the pinch roller 45 supported by the roller holding member 70 to be rocked toward the rocking frame 30. With no obstacle present on the side of the sheet forward path of the body frame, an operation such as maintenance or replacement of the image forming member 10 can be performed easily. Further, when the rocking frame 30 is closed from the condition shown in FIG. 13, the roller holding member is rocked clockwise through the support shaft 31 together with the rocking frame to reset the rocking frame to a position shown in FIG. 11, thus making the printer readily operable.

In the above-mentioned printer, the means for moving the rocking frame from the body frame may be arranged so that two different degrees of movement are set, one degree for removal of a jammed sheet and the other for attaching and detaching the image forming member. As a result, the two types of operations, the operation of opening the sheet forward path and the maintenance of the image forming member, can be performed with the rocking frame opened to respectively suitable degrees.

As is apparent from the foregoing description, according to the invention, the image forming apparatus is designed so that the rocking frame can be separated from the body frame containing the image forming member and the like with the sheet forward path as a border. Therefore, the sheet forward path can be opened and closed easily. Further, the opening/closing frame can be opened with the sheet forward path as a border by two different degrees of opening angle, and this prevents the opening/closing frame from being opened excessively. Furthermore, when the opening/closing frame is opened by a small degree, the nip at the forward roller unit is released, while when it is opened by a large degree, the forward roller unit is distanced away from the apparatus body to allow maintenance of the image forming member or a like operation to be performed easily. Therefore, the apparatus of the invention can not only improve the operability in performing various handling operations, but also simplify its structure.

What is claimed is:

1. An image forming apparatus comprising:

a body frame;

an image forming unit having at least a photoreceptor and being detachably contained in said body frame;

means for forwarding a sheet to said image forming unit, said forwarding means having at least first and second members for forwarding said sheet to said image forming unit, said first and second members being disposed adjacent to said body frame;

a cover moveable to first and second open positions, said cover being disposed farther from said body frame when said cover is in said second open position than when said cover is in said first open position; and coupling means for coupling said cover with said forwarding means so that when said cover is moved to said first open position, said first member of said forwarding means is moved away from said body frame, and when said cover is moved to said second open position, said second member of said forwarding means is moved away from said body frame.

2. The image forming apparatus according to claim 1, wherein said cover is supported rockably relative to said body frame.

3. The image forming apparatus according to claim 1, wherein said first member of said forwarding means is supported by said cover and moves together with said cover.

4. The image forming apparatus according to claim 1, wherein said first and second members of said forwarding means comprise two confronting rollers.

5. The image forming apparatus according to claim 3, wherein said coupling means has a gear train rocking said second member in accordance with a movement of said cover between said first open position and said second open position.

6. The image forming apparatus according to claim 4, wherein said first member of said forwarding means is a pinch roller and said second member of said forwarding means is a drive roller.

7. The image forming apparatus according to claim 6, further comprising a sheet feed cassette having a plurality of sheets stacked, each of said plurality of sheets individually being forwarded from said sheet feed cassette between said pinch roller and said drive roller to said image forming unit, and said forwarding means further includes a sheet regulating pad confronting said drive roller and said forwarding means supplies a manually fed sheet between said drive roller and said sheet regulating pad.

8. The image forming apparatus according to claim 7, further comprising a roller holding member supporting said pinch roller and said regulating pad, said pinch roller and said regulating pad being rocked integrally through said roller holding member.

9. The image forming apparatus according to claim 1, wherein said cover is slidably supported relative to said body frame.

10. The image forming apparatus according to claim 3, wherein said coupling means includes:

a slot provided on said cover, a pin guided by said slot, a resilient member for coupling said pin and said cover, and a wire for coupling said pin and said second member of said forwarding means.

* * * * *